US007020983B2

(12) United States Patent
Bolduan et al.

(10) Patent No.: US 7,020,983 B2
(45) Date of Patent: Apr. 4, 2006

(54) METHOD AND APPARATUS FOR DRYING ITEMS OF CLOTHING

(75) Inventors: Edwin Bolduan, Berlin (DE); Wolfgang Proppe, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/608,607

(22) Filed: Jun. 27, 2003

(65) Prior Publication Data

US 2004/0000068 A1 Jan. 1, 2004

Related U.S. Application Data

(63) Continuation of application No. PCT/EP01/14866, filed on Dec. 17, 2001.

(30) Foreign Application Priority Data

Dec. 27, 2000 (DE) ..... 100 65 334
Dec. 27, 2000 (DE) ..... 100 65 335
Dec. 27, 2000 (DE) ..... 100 65 336

(51) Int. Cl.
*F26B 13/00* (2006.01)

(52) U.S. Cl. ..... 34/506; 34/582; 34/621; 34/639; 34/644

(58) Field of Classification Search ..... 34/260, 34/329, 335, 336, 337, 355, 381, 382, 397, 34/398, 399, 400, 437, 438, 439, 440, 501, 34/502, 506, 508, 582, 583, 69, 70, 71, 95.3, 34/104, 614, 615, 621, 639, 644
See application file for complete search history.

(56) References Cited

U.S. PATENT DOCUMENTS

| | | | | | |
|---|---|---|---|---|---|
| 633,819 | A | * | 9/1899 | Dobson | 34/621 |
| 3,875,681 | A | * | 4/1975 | De Pas | 34/75 |
| 4,112,586 | A | * | 9/1978 | Lehtinen | 34/355 |
| 4,270,281 | A | * | 6/1981 | Muller | 34/75 |
| 4,304,053 | A | * | 12/1981 | Kellerhals et al. | 34/621 |
| 4,592,497 | A | * | 6/1986 | Georges | 223/69 |
| 4,625,432 | A | * | 12/1986 | Baltes | 34/621 |
| 4,682,424 | A | * | 7/1987 | Irving | 34/621 |
| 5,361,516 | A | * | 11/1994 | Dahman | 34/440 |
| 5,433,919 | A | | 7/1995 | Baltes | |
| 5,713,137 | A | * | 2/1998 | Fujita | 34/106 |
| 5,953,830 | A | * | 9/1999 | Jannach | 34/104 |
| 6,357,140 | B1 | * | 3/2002 | Heyer et al. | 34/236 |

FOREIGN PATENT DOCUMENTS

| | | |
|---|---|---|
| DE | 2 035 540 | 1/1972 |
| DE | 31 19 560 A1 | 12/1982 |
| EP | 0 594 085 A1 | 4/1994 |

* cited by examiner

*Primary Examiner*—Kenneth Rinehart
(74) *Attorney, Agent, or Firm*—John T. Winburn; Russell W. Warnock; Craig J. Loest

(57) ABSTRACT

Instead of desiccating articles of clothing by spinning the articles, the method and apparatus according to the invention removes moisture from these articles by pressing or drying them with the aid of hot air. Desiccation of the clothing articles occurs gently and with a low expenditure of energy by subjecting the articles to the action of at least one gas jet and, in particular, of a compressed air jet, which is not aligned parallel to the surface of the article of clothing to exert a force upon the article. Advantageously, the article of clothing is subjected to the action of gas jets on both sides.

16 Claims, 2 Drawing Sheets

METHOD AND APPARATUS FOR DRYING ITEMS OF CLOTHING

CROSS-REFERENCE TO RELATED APPLICATION

This application is a continuation of copending International Application No. PCT/EP01/14866, filed Dec. 17, 2001, which designated the United States and was not published in English.

BACKGROUND OF THE INVENTION

Field of the Invention

The invention relates to a method and an apparatus for drying items of clothing.

Numerous methods and apparatuses for drying items of clothing are known. For example, it is known to centrifuge items of clothing to be dried, in particular, in a drum provided with openings, to separate liquid picked up by the items of clothing. Furthermore, it is known to press liquid out of items of clothing. However, these known methods have the disadvantage that the fabric of the clothing is creased intensely. As a result, subsequent calendering or ironing is made more difficult. Furthermore, it is known to dry wet clothing with hot air, but this disadvantageously needs a great deal of energy.

SUMMARY OF THE INVENTION

It is accordingly an object of the invention to provide a method and apparatus for drying items of clothing that overcomes the hereinafore-mentioned disadvantages of the heretofore-known devices and methods of this general type and with which, with little expenditure on energy, moisture can be removed gently from the clothing.

With the foregoing and other objects in view, there is provided, in accordance with the invention, a method for drying items of clothing, including the steps of providing an item of clothing, providing at least one gas jet for supplying a stream of a gas, and drying the clothing item at least in one portion thereof with the gas stream in a direction not parallel to the one portion.

As a result of the use of a gas jet, which is, preferably, an air jet and can exert a force on the item of clothing to be dried, moisture can be removed from the item of clothing with little expenditure of energy, the clothing being treated gently because it is not pressed together by solid parts. The moisture to be removed can be, in particular, washing liquid or rinsing liquid for rinsing out washing liquid that is used in washing the items of clothing.

In accordance with another mode of the invention, the item of clothing can be acted on only from one side by gas jets or compressed air jets, by which the moisture is forced out on the other side by the gas pressure.

In accordance with a further mode of the invention, the drying action can be improved by acting with a more intense gas jet. As a result, however, a higher force necessarily acts on the item of clothing and increases the risk that the clothing will move away from the gas jet. This can, for example, be prevented to a low extent by using a gas jet that, although it has a high outflow velocity, has a low diameter. This leads to the gas jet, overall, not exerting any great force on the item of clothing and, therefore, influencing the latter less in terms of its position but, in a small region of the item of clothing, exerting a high pressure on the fabric. In such a case, provision can be made that, in the case of suspended clothing, the deflection arising from the gas jet is at least partly compensated for by the suspension of the clothing being brought up somewhat toward the nozzle from which the gas jet flows.

To have a powerful gas jet act on the item of clothing without the latter moving away from the gas jet, as a result of which the action would be made worse, the item of clothing is, advantageously, supported, preferably, from a side of the clothing item opposite the at least one gas jet. The support can be provided by fixed supports such as at least one supporting surface. If the item of clothing is moved, for example, to pass through a plurality of treatment stations, supports of this type can also be set up such that they can move together with the item of clothing. For example, at least one supporting roller can be used, which is mounted such that it can rotate about an axis that is aligned at least substantially at right angles to the direction of movement of the item of clothing.

For the purpose of support, in accordance with an added mode of the invention, the item of clothing can be disposed between two air-permeable surfaces, such as grids. As a result, it is fixed in both directions against deflection by gas jets and a high force can be exerted by gas jets, and, therefore, an intense drying action can be achieved.

In accordance with an additional mode of the invention, the item of clothing is supported by a gas jet. In such an embodiment, the item of clothing is acted on from both sides by at least one gas jet. As such, imprints in the fabric, which can be caused by fixed supports, can be avoided or, at least, reduced. For such a purpose, the gas jets acting from both sides can be set up such that the total force exerted by them is oriented against each other and is equal in magnitude.

In accordance with yet another mode of the invention, the gas jets acting from both sides can, in particular, be coordinated with one another such that, in the region located, in between, sections of the item of clothing lying beside one another are in each-case acted on from both sides with different pressure. As such, in a specific section, the pressure acting from one side always predominates so that the moisture can be pressed out on the other side. This asymmetric action on the clothing is recommended, in particular, in the case of thin items of clothing, through which the gas jet can pass, at least to some extent. For example, from one side, a gas jet that widens conically and is hollow on the inside can be used so that, at the surface of the item of clothing, it exerts a force in an annular region, and from the other side, a gas jet is used that only produces a force in a small point-like or circular region, the point-like or circular region being located within the annular region of the force exerted from the opposite side. Furthermore, the gas jets acting from both sides on the item of clothing can result in a force distribution with a line pattern, the forces acting from the two sides being opposite gaps in one another or a pressure maximum on one side being located opposite a pressure minimum on the other side.

Furthermore, the gas jets acting from the two sides can be set up such that the forces acting on the item of clothing are symmetrical, so that, on a specific section of the item of clothing, the same pressure acts from one side as from the other side. In such a case, the item of clothing is pressed together gently so that the liquid at the edges of the section acted on is pressed out. This symmetrical action can be applied, in particular, in the case of thicker items of clothing. The item of clothing and the gas jets are, advantageously, moved relative to one another such that the item of clothing is acted on by the gas jets moving from top to bottom so that the liquid is pressed downward with the assistance of the force of gravity. At the bottom, the liquid drips off or is pressed out. In such a case, the gas jets can be linear and can extend at least over the width of the item of clothing without interruption so that the liquid cannot flow upward again at the edges of the section acted on. The gas jets acting symmetrically from both sides can also be inclined downward somewhat to urge the liquid in this direction in an intensified manner.

In accordance with yet a further mode of the invention, the forces acting from both sides can be coordinated with one another such that the item of clothing is kept in a specific local region and, in particular, the item of clothing is prevented from coming into unintentional contact with other parts, by which soiling or creasing can be prevented. Because the force of a gas jet used decreases with the distance from the nozzle, by the configuration, the alignment, and the outflow characteristics of nozzles that are located opposite one another and aimed at one another, a control system can be created that attempts to keep the item of clothing at a specific location between the nozzles. In such a case, however, provision can also be made for the location of the item of clothing or a section of the item of clothing to be registered, and for the registered location to be used as an input variable for a control system, which controls the gas jets acting on the item of clothing from the different sides such that the item of clothing or the section of the item of clothing is always located at a predefined intended location or intended location region. The registration of location can be carried out with light barriers or reflective light barriers, it also being possible for other methods of distance measurement or location registration, for example, by ultrasound, to be used.

In accordance with yet an added mode of the invention, the gas jet is provided with heated gas and/or water vapor.

In accordance with yet an additional mode of the invention, at an end of the drying step, the gas jet is heated to calender the clothing item initially with substantially dry and heated air and then with substantially dry and non-heated air.

In accordance with again another mode of the invention, an outflow speed, a volume flow, and/or a directional distribution of the gas jet are varied while drying the clothing item.

With the objects of the invention in view, there is also provided a method for drying items of clothing, including the steps of providing an item of clothing, providing at least one gas jet for supplying a stream of a gas, and drying the clothing item by directing the gas stream to at least one portion of the clothing item at an angle to the one portion.

With the objects of the invention in view, there is also provided a method for drying items of clothing, including the steps of providing an item of clothing, providing at least one gas jet for supplying a stream of a gas, drying the clothing item at least in one portion thereof with the gas stream in a direction not parallel to the one portion, supporting the clothing item from a side of the clothing item opposite the at least one gas jet, supporting the clothing item by exerting gas streams from gas jets on both sides of the clothing item in a direction of each other, moving the at least one gas jet and the clothing item relative to one another, providing the at least one gas jet with at least one of heated gas and water vapor, at an end of the drying step, heating the gas jet to calender the clothing item initially with substantially dry and heated air and then with substantially dry and non-heated air, and varying at least one of an outflow speed, a volume flow, and a directional distribution of the at least one gas jet while drying the clothing item.

With the objects of the invention in view, there is also provided an apparatus for drying items of clothing, including a housing defining a treatment space, devices disposed in the housing for disposing items of clothing within the treatment space, a blower disposed at the housing for producing a gas flow, and nozzles disposed in the housing and communicating with the blower, the nozzles being aligned to direct the gas flow produced by the blower to an item of clothing in the treatment space.

In accordance with again a further feature of the invention, the nozzles are aligned with respect to one portion of the clothing item to direct the gas flow in a direction not parallel to the one portion.

In accordance with a concomitant feature of the invention, the nozzles direct the gas flow at an angle with respect to one portion of the clothing item.

Other features that are considered as characteristic for the invention are set forth in the appended claims.

Although the invention is illustrated and described herein as embodied in a method and apparatus for drying items of clothing, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
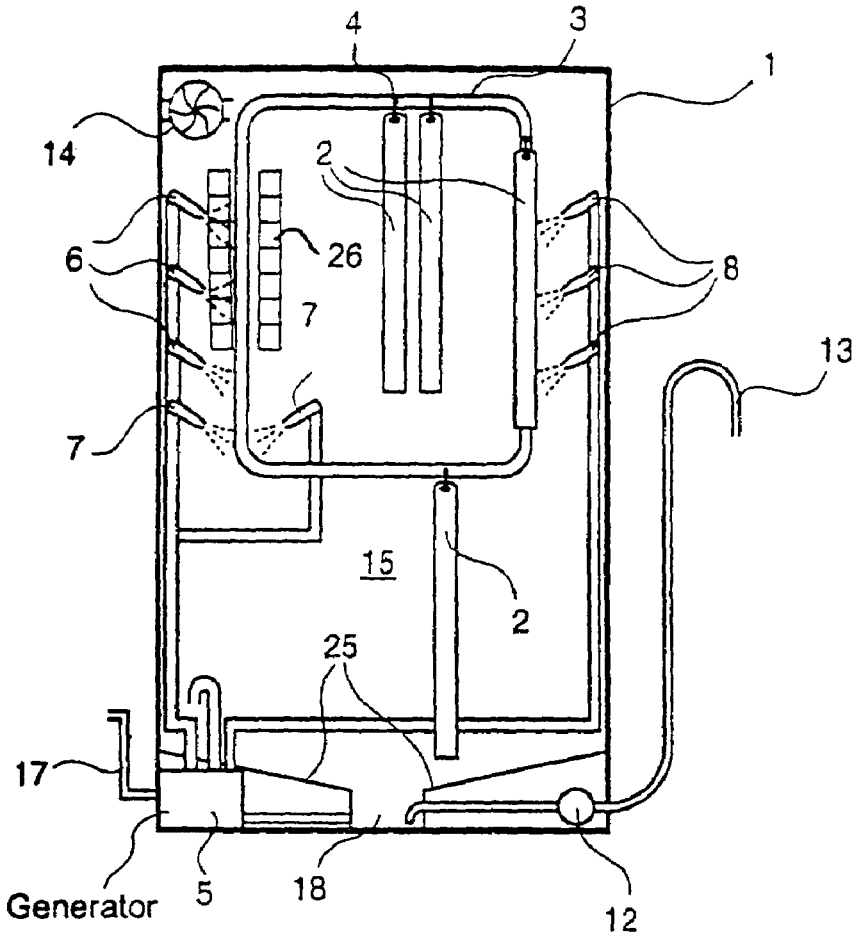
FIG. 1 is a cross-sectional view of a first embodiment of an apparatus for calendering items of clothing according to the invention.

Referring now to the figures of the drawings in detail and first, particularly to FIG. 1 thereof, there is shown an apparatus for washing and calendering items of clothing 2, such as shirt-like clothing or trousers and the like, has a box-like or cabinet-like housing 1 that is used to accommodate the clothing 2 to be calendered. Disposed inside the housing 1, on two opposite inner walls, there is in each case an endless transport belt 3 that is mounted such that it circulates, a transport belt 3 being visible in plan view in FIG. 1. The two transport belts 3 can be driven in the same direction and at the same circumferential speed in the clockwise direction. Disposed between the transport belts 3 are non-illustrated connecting struts on which hanging devices 4 are fixed, on which the clothing 2 to be calendered is suspended. The hanging devices 4 have substantially the form of a clothes hanger so that clothing of all types, in particular, outer clothing, such as jackets, trousers, and the like, can be suspended thereon.

The transport belts 3 are disposed in the upper region of the housing 1 and have the form of a square so that the clothing 2 can be moved upward on the left-hand side, to the right at the top, downward on the right-hand side, and to the left at the bottom. On the left-hand side wall of the housing 1 (as viewed in FIG. 1), two compressed air nozzles 7 positioned opposite each other are disposed such that the items of clothing can be moved upward through the interspace between the compressed air nozzles 7 by the transport belts 3. Above the compressed air nozzles 7, hot air nozzles 6 are disposed one above another on the left-hand side wall, with the hot air nozzles 6 being disposed only on the outer side of the movement path of the items of clothing 2 so that the items of clothing can be acted on only from one side by the hot air nozzles. The compressed air nozzles 7 and the hot air nozzles 6 are connected to a generator 5, which has a blower and can produce air streams at different temperatures and at different pressures. The generator 5 has an air inlet inside the housing 1 and an air inlet 17 outside the housing 1, with which fresh air can be taken in. Also, the item of clothing 2 can be disposed between two air-permeable surfaces 26.

Disposed on the right-hand side wall (as viewed in FIG. 1) are liquid nozzles 8 for spraying washing liquid and rinsing liquid. The liquid nozzles 8 are, likewise, connected to the generator 5, which also has a pump for delivering liquids.

For the supply of liquid, the generator 5 has a non-illustrated fresh water supply that can be connected to a fresh water source or a water connection in a household, and is also connected to a sump 18 within the housing 1. The sump 18 is formed in a false bottom 25, which is disposed at the bottom inside the housing 1 and is shaped such that all the liquid from the upper part of the housing 1 collects at the bottom in the sump 18. The false bottom 25 also has the function of dividing off a dry space, in which the generator 5 is accommodated. Also disposed in the dry space is a discharge pump 12, whose inlet opens into the sump 18 and whose outlet 13 leads to the outside and can be connected to a waste water connection, in particular, of a household.

The generator 5 is set up such that it can supply the liquid nozzles 8 either with liquid that the generator 5 has taken in from the sump 18 or that originates from the fresh water supply. Furthermore, the generator 5 has a heating device for the liquid pumped to the liquid nozzles 8.

Figure 2:
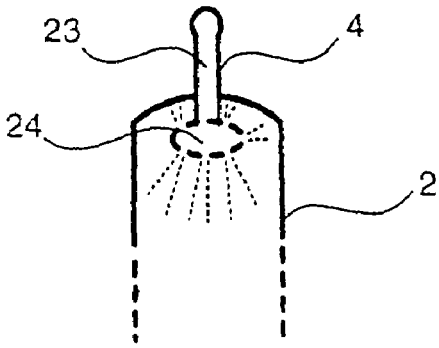
FIG. 2 is a fragmentary, cross-sectional view through an apparatus for disposing items of clothing for use in the calendering apparatus of FIG. 1.

In FIG. 2, a hanging device 4 is illustrated in section by way of example, having a hollow connecting section 23 and a bow section 24 connected to the latter at the bottom, which extends at right angles to the plane of the drawing and has a length that corresponds substantially to the width of an item of clothing 2. The bow section 24 is hollow and has openings distributed over its circumference. The hanging devices 4 are connected to the generator 5 through devices that are not shown, such that the interior of the connecting sections 23 and of the bow sections 24 can be supplied with hot air, just like the hot air nozzles 6.

Using the apparatus according to the invention illustrated in FIG. 1, clothing 2 can, first, be washed, dried and then calendered, it not being necessary for the clothing 2 to be removed from the apparatus. First of all, the items of clothing 2 are suspended on the hanging devices 4. For this purpose, the hanging devices 4 can be removed from the housing 1, the items of clothing 2 can be hung on the hanging devices 4 and the latter can then be hooked in on the connecting struts between the transport belts 3 in the housing 1. After the housing 1 has been closed, the washing operation is initiated. For such a purpose, the transport belts 3 are rotated to move the clothing 2 in the clockwise direction through the housing, and the generator 5 is driven by a non-illustrated control system such that it leads fresh water from the fresh water supply to the liquid nozzles 8. In the process, the water is led through a non-illustrated injection device into which detergent can be put either in powdered and/or liquid form. In the process, the detergent is injected into the housing 1. As soon as a desired level of liquid in the housing has been reached or a specific predefined quantity of liquid has run in, the generator 5 stops the supply of fresh water and begins to remove water from the sump 18 and lead it to the liquid nozzles 8, the water being heated up to an intended temperature. The water, to which the detergent has been added in the meantime, is, in this way, circulated as washing liquid and can, additionally, be sprayed onto the clothing 2 from the inside through the hanging devices 4. In such a pass, dirt is washed out of the clothing 2.

Then, in a rinsing phase, the discharge pump 12 pumps the washing liquid away into a wastewater connection. The clothing 2 is, then, rinsed to remove the washing liquid from it. For such a purpose, in a number of rinsing passes, fresh water is pumped to the liquid nozzles 8 and the water, together with the washing liquid rinsed out, is pumped away by the discharge pump 12. The rinsing action is intensified in that, at the end of each rinsing pass, the liquid supply to the liquid nozzles 8 is interrupted and the compressed air nozzles 7 are supplied with compressed air. If the clothing 2 is moved through between the compressed air nozzles 7, it is pressed together by the compressed air jets. As a result, the rinsing liquid is forced out of it. As such, following a rinsing pass, fewer residues of the washing liquid or soiling remain so that a lower number of rinsing passes and, respectively, less rinsing liquid is required. The air led to the compressed air nozzles 7 can also be heated in the process. As a result, the liquid drawn out of the items of clothing 2 flows away more easily and, thus, the dewatering by compressed air at the end of the rinsing passes can be intensified. To press a great deal of liquid out of the items of clothing, the compressed air nozzles 7 are acted on at a very high pressure.

After rinsing, the drying and calendering step follows. First of all, the items of clothing 2 are dried down to a defined moisture. For such a purpose, heated air is led to the hot air nozzles 6. At the same time, the rear wall 15 of the housing is cooled with fresh water from the fresh water connection. As such, the moisture removed from the clothing 2 condenses on the rear wall 15 and runs into the sump 18, from which, together with the cooling water for the rear wall 15, it can be pumped away by the discharge pump 12. In such a case, the air within the housing 1 is circulated, for which purpose the generator 5 takes in the air inside the housing 1.

Furthermore, there is the possibility of drying the items of clothing 2 down to the desired moisture in accordance with the waste air principle, in that, by a blower 14, air from the interior of the housing 1 is continually blown to the outside. As such, the moisture removed from the items of clothing 2 is led to the outside, it being necessary for the generator 5 to take in the air from outside. However, this method requires the apparatus to be set up in an adequately ventilated room in order to carry away the moisture led to the outside. By the two possibilities, of condensing the liquid either in the apparatus and pumping it away or of leading it to the outside, an operator can decide between the two variants in accordance with the respective conditions. Condensing the moisture in the apparatus has the advantage that the room where it is set up does not have to be ventilated. As a result, advantageously, for example, in winter, no energy for heating the room where it is set up is lost. In summer, on the other hand, the waste air variant can be chosen because no fresh water is needed for cooling the rear wall 15 and less energy is needed for heating the drying air.

When the desired moisture has been reached, the calendering operation can be started. For such a purpose, the items of clothing 2 are acted on with hot compressed air with the aid of the compressed air nozzles 7, the clothing 2 being completely dried in the process. In the moist state, the fabric of the clothing 2 is still expanded so that it can be calendered significantly better. The calendering is carried out by the force exerted by the compressed air jets from the compressed air nozzles 7 on the clothing. This force can be set to the desired action by the pressure of the air led to the compressed air nozzles 7. In particular, the force is set such that the items of clothing 2 do not flutter but, instead, the section of an item of clothing 2 respectively located between the compressed air nozzles 7 is tensioned tautly. The compressed air used in the calendering step has a lower pressure than the compressed air used for drying at the end of the washing phase. During calendering, an excessively high air pressure can be disadvantageous if the items of clothing 2 are caused to flutter or are creased as a result.

For example, during calendering, the two compressed air nozzles 7 can exert differently distributed surface forces on the items of clothing so that the forces acting from both sides on a specific part of an item of clothing 2 do not cancel each other out. The surface force profiles of the forces exerted by the two compressed air nozzles 7 are, advantageously, complementary so that, for example, in the regions in which a high surface force is produced by the left-hand compressed air nozzle 7 (viewed with respect to FIG. 1), a low surface force is produced by the right-hand compressed air nozzle 7, and vice-versa. In such a case, the forces are configured such that the items of clothing are kept approximately centrally between the two compressed air nozzles 7.

As such, by compressed air, tensioning forces can be exerted on an item of clothing 2, which tension individual fabric sections of the item of clothing 2 and, as a result, calender it. This procedure is repeated each time a specific item of clothing 2 is led through between the two compressed air nozzles 7. During this procedure, it is also possible for heated hot air to be aimed at the items of clothing by the hot air nozzles 6. In the process, care must be taken that the hot air is expelled only at a low pressure, in order not to lead to fluttering or creasing of the items of clothing 2. During the calendering operation, the items of clothing 2 are dried further, the removed moisture, as described previously, either being condensed on the cooled rear wall 15 and pumped away by the discharge pump 12 or being collected in the device and fed in again during the next washing process or blown to the outside by the blower 14.

As soon as the items of clothing 2 have been dried completely, they are moved further in the housing 1, but only cold air still being blown through the hot air nozzles 6 and/or the compressed air nozzles 7. As such, the calendered items of clothing 2 are cooled down and become less sensitive to creasing because the fabric creases more easily in the hot state. Furthermore, an operator is prevented from being burned on hot parts within the housing 1. After the items of clothing 2 and the apparatus have cooled down, the items of clothing 2 can be removed.

To calender the items of clothing 2 without a previous washing pass, the items of clothing can be moistened with little fresh water from the liquid nozzles 8 so that the fabric of the clothing 2 is expanded. After that, the items of clothing 2 can be calendered and dried as described previously.

Figure 3:
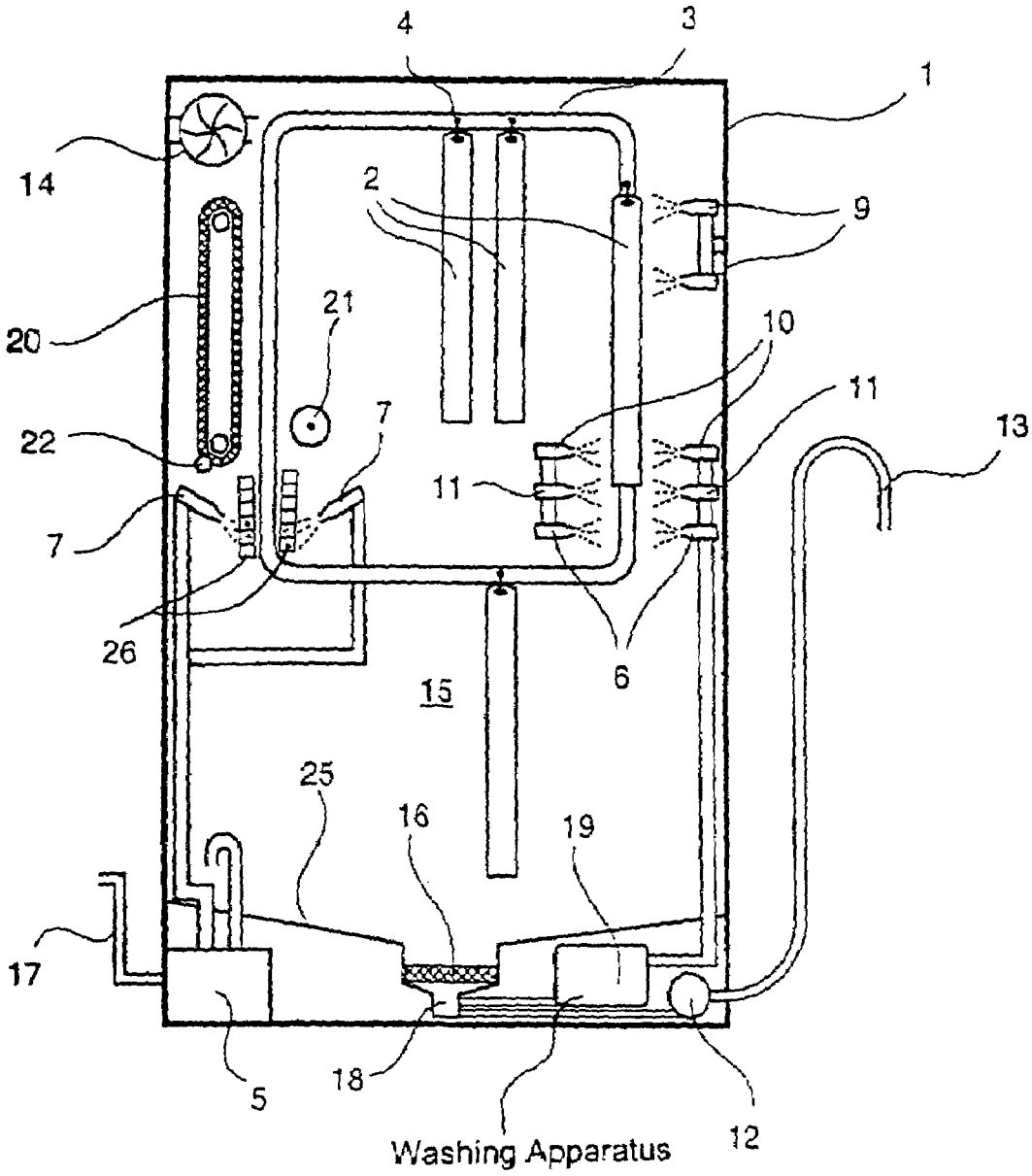
FIG. 3 is a cross-sectional view of a second embodiment of an apparatus for calendering items of clothing according to the invention.

FIG. 3 illustrates a second embodiment of the apparatus for washing and calendering items of clothing 2. In the second embodiment, a device for the mechanical pre-drying of the items of clothing 2 is provided additionally, by which, at the start of the drying phase, liquid can be removed from the items of clothing mechanically so that less energy has to be expended for the drying. Furthermore, separate nozzles are provided for the various treating liquids and gases.

Just as in the first embodiment, the apparatus has a housing 1, two transport belts 3, hanging devices 4 for items of clothing 2, and a discharge pump 12 with an outlet 13. Furthermore, a false bottom 25 is, likewise, disposed in the housing 1, in which a sump 18 with a lint filter 16 is formed and which, at the bottom, divides off a drying space in the housing 1. However, in the second embodiment, the generator 5 is set up only to produce compressed air, which may be heated, which is led to the compressed air nozzles 7. Also disposed in the dry space underneath the false bottom 25 is a washing apparatus 19, which is connected to the sump 18 and to a non-illustrated fresh water supply, having a liquid pump and a heating device. The washing apparatus 19 is set up such that it can remove liquid either from the fresh water supply or from the sump 18 and pass it on to the various nozzles, it being possible for the liquid to be heated and, in particular, for liquid taken from the fresh water supply to be evaporated. Also provided in the washing apparatus is an injection device, with which detergent can be injected into the housing 1.

Connected to the washing apparatus 19 are wetting nozzles 9, washing nozzles 10, rinsing nozzles 11, and hot steam nozzles 6, which are disposed on the right-hand side of the housing 1 with regard to FIG. 3. The wetting nozzles 9 are supplied with fresh water and are used for wetting dry clothing 2. The washing nozzles 10 are supplied with washing liquid, in particular, heated washing liquid, which, in particular, is circulated through the sump 18 and is used for washing the clothing 2. The rinsing nozzles 11 are supplied with cold fresh water and are used for rinsing the washing liquid out of the clothing 2. The hot steam nozzles 6 are supplied with heated steam, which is obtained from fresh water, and are used for steaming the clothing 2.

Disposed on the left-hand inner wall of the housing 1 (as viewed in FIG. 3), at the bottom, as in the previous exemplary embodiment, are two opposed compressed air nozzles 7, which are connected to the generator 5. Disposed over the compressed air nozzles 7 is a wet felt fabric or nonwoven 20 that, by two deflection rollers, is mounted close to the inner wall such that it can be driven like a conveyor belt and, in the process, is moved parallel to the movement path of the clothing 2. The nonwoven 20 is of a highly absorbent material and, in this case, is driven at the same speed as the clothing 2 so that the respective inner section moves upward together with the clothing 2. On the side of the transport belt 3 located opposite the nonwoven 20 is a pressure roller 21, which is provided with a compliant covering. The distance between the pressure roller 21 and the nonwoven 20 can be varied, so that it is possible either to press together the items of clothing 2 between the pressure roller 21 and the nonwoven 20 as they move through, or to move the items of clothing 2 through without contact with the nonwoven 20. Provided on the lower deflection roller of the nonwoven 20 is a squeezing or expressing roller 22, which is disposed at such a short distance from the lower deflection roller that the nonwoven 20 is highly compressed between the lower deflection roller and the squeezing roller 22 and, as such, liquid contained in the nonwoven 20 is pressed out.

To wash and calender the items of clothing 2, these are suspended in the housing 1 by the hanging devices 4 as described previously. The transport belts also move in the clockwise direction in this exemplary embodiment. First of all, the items of clothing 2 are wetted with fresh water by the wetting nozzles 9. The items of clothing 2 are, then, moved onward to the washing nozzles 10, by which they are sprayed with washing liquid, which is produced in the washing apparatus 19 by injecting detergent into fresh water. The washing liquid is pumped out of the sump 18 in circulation by the washing apparatus 19, is heated and sprayed onto the items of clothing 2 so that contaminants are rinsed out.

Following washing, the washing liquid is pumped away by the discharge pump 12 and the items of clothing 2 are rinsed in order to rinse washing liquid and residues of the contaminants out. For such a purpose, fresh water is sprayed onto the items of clothing 2 by the rinsing nozzles 11 in a number of rinsing passes and is pumped away. The rinsing procedure can be configured as in the previous exemplary embodiment.

Following rinsing, the items of clothing 2 are further dried mechanically by the nonwoven 20. For such purpose, the distance between the nonwoven 20 and the pressure roller 21 is reduced to such an extent that an item of clothing 2 moved through is pressed against the nonwoven 20 by the pressure roller 21. In the process, the highly absorbent material of the nonwoven 20 extracts further moisture from the item of clothing 2. The moisture picked up by the nonwoven 20 is pressed out again between the lower deflection roller and the expressing roller 22 so that precisely that part of the nonwoven 20 that comes into contact with an item of clothing 2 always contains as little moisture as possible so that as much liquid as possible is extracted from the item of clothing 2. This purely mechanical type of drying needs no heat, for the production of which a great deal of energy is disadvantageously required. Thus, with the aid of the nonwoven 20, the moisture content of the items of clothing 2 can be reduced with particularly little expenditure of energy.

Furthermore, with such drying, because of the sucking action of the nonwoven 20, a great deal of moisture can be extracted from the items of clothing 2 even with a low pressing pressure, so that the items of clothing 2 are not creased and are, nevertheless, largely dried. The pressing pressure can be adjusted by varying the distance between the pressure roller 21 and the nonwoven 20, in particular, depending on the fabric and the thickness of the items of clothing 2.

Following the pre-drying by the nonwoven 20, the items of clothing 2 are dried further with hot air. This is done in the same way as in the previous exemplary embodiment. The calendering operation is begun as soon as the items of clothing have the suitable amount of moisture. If the items of clothing have already been dried adequately by the nonwoven 20, the items of clothing 2 can be calendered immediately after the mechanical pre-drying. If the mechanical pre-drying was not sufficient, the items of clothing 2 are dried down to the suitable moisture with warm or hot air from the compressed air nozzles 7. Calendering is carried out by applying hot steam from the hot steam nozzles 6 to the items of clothing. As a result, the fabric of the items of clothing 2 is heated and expanded. The items of clothing 2 are, then, led through between the two compressed air nozzles 7. By the compressed air emerging from the compressed air nozzles 7, the fabric of the items of clothing 2 is tensioned and calendered, the calendering operation and the compressed air jets used corresponding to the previous exemplary embodiment.

In the second embodiment, by the hot steam nozzles 6, it is possible to calender the items of clothing 2 without previous thorough wetting. For such a purpose, for example, items of clothing 2 already washed and dried can be steamed in the apparatus and, then, calendered and dried as described previously.

Following a specific time, the discharge of hot steam from the hot steam nozzles 6 is stopped. The items of clothing are, then, acted on only with hot compressed air from the compressed air nozzles 7 to dry them completely during calendering. As soon as the desired moisture has been reached, the items of clothing are acted on only with cold air to cool them down as in the previous exemplary embodiment. After that, the items of clothing 2 can be removed from the housing 1.

We claim:

1. A method for drying items of clothing, which comprises:

providing an item of clothing;

providing at least one gas nozzle for supplying a jet of a gas;

moving said at least one gas nozzle and the clothing item relative to one another;

impacting the jet of gas on at least one portion the clothing item in a direction not parallel to the at least one portion of the clothing item for dehumidifying the at least one portion of the clothing item; and providing the at least one gas nozzle with water vapor.

2. A method for drying items of clothing, which comprises:

providing an item of clothing;

providing at least one gas nozzle for supplying a jet of a gas;

moving said at least one gas nozzle and the clothing item relative to one another;

impacting the jet of gas on at least one portion the clothing item in a direction not parallel to the at least one portion of the clothing item for dehumidifying the at least one portion of the clothing item; and varying at least one of an outflow speed, a volume flow, and a directional distribution of the at least one jet of gas while drying the clothing item.

3. A method for drying items of clothing, which comprises:

providing an item of clothing;

providing at least one gas nozzle for supplying a jet of a gas;

moving said at least one gas nozzle and the clothing item relative to one another;

impacting the jet of gas on at least one portion the clothing item in a direction not parallel to the at least the portion of the clothing item for dehumidifying the at least one portion of the clothing item;

supporting the clothing item from a side of the clothing item opposite the at least one gas nozzle; and supporting the clothing item by a gas nozzle.

4. The method according to claim 3, which further comprises supporting the clothing item with a supporting surface.

5. The method according to claim 3, which further comprises supporting the clothing item with an air-permeable supporting surface.

6. The method according to claim 3, which further comprises disposing the clothing item between two air-permeable surfaces.

7. The method according to claim 3, which further comprises exerting jets of gas from gas nozzles on both sides of the clothing item in a direction of each other having a total force on the clothing item equal in magnitude.

8. The method according to claim 3, which further comprises:

providing at least two gas nozzles disposed on opposite sides of the clothing item and facing one another; and directing jets of gas on both sides of the clothing item with a total force on the clothing item being equal in magnitude.

9. The method according to claim 3, which further comprises exerting jets of gas from gas nozzles on both sides of the clothing item in a direction of each other on sections of the clothing item with one of the gas nozzles having a higher force than another one of the gas nozzles.

10. The method according to claim 3, which further comprises exerting jets of gas from gas nozzles on both sides of the clothing item in a direction of each other on sections of the clothing item with the gas nozzles having substantially the same force on both sides.

11. The method according to claim 3, which further comprises providing the at least one gas nozzle with heated gas.

12. The method according to claim 3, wherein the jet of gas contains heated gas.

13. The method according to claim 3, wherein the jet of gas contains water vapor.

14. The method according to claim 3, which further comprises, at an end of the drying step, heating the gas nozzle to calender the clothing item initially with substantially dry and heated air and then with substantially dry and non-heated air.

15. A method for drying items of clothing, which comprises:

providing an item of clothing;

providing at least one gas jet for supplying a stream of a gas;

drying the clothing item at least in one portion thereof with the gas stream in a direction not parallel to the one portion;

supporting the clothing item from a side of the clothing item opposite the at least one gas jet;

supporting the clothing item by exerting gas streams from gas jets on both sides of the clothing item in a direction of each other;

moving the at least one gas jet and the clothing item relative to one another;

providing the at least one gas jet with at least one of heated gas and water vapor;

at an end of the drying step, heating the gas jet to calender the clothing item initially with substantially dry and heated air and then with substantially dry and non-heated air; and varying at least one of an outflow speed, a volume flow, and a directional distribution of the at least one gas jet while drying the clothing item.

16. An apparatus for drying items of clothing, comprising:

a housing defining a treatment space;

devices disposed in said housing for disposing items of clothing within said treatment space;

a blower disposed at said housing for producing a gas flow; and nozzles disposed in said housing and communicating with said blower, said nozzles being aligned to impact a jet of gas of the gas flow produced by said blower on at least one portion of an item of clothing in said treatment space in a direction not parallel to the at least one portion of the clothing, and said gas nozzle and the clothing item being moveable relative to one another for dehumidifying the at least one portion of the clothing item.

* * * * *